US009898965B2

(12) United States Patent
Zhou

(10) Patent No.: US 9,898,965 B2
(45) Date of Patent: Feb. 20, 2018

(54) PIXEL DRIVING CIRCUIT, PIXEL DRIVING METHOD AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Anhui (CN)

(72) Inventor: Maoxiu Zhou, Beijing (CN)

(73) Assignees: BOE TECHNOLOGY GROUP CO., LTD. (CN); HEFEI XINSHENG OPTOELECTRONICS TECHNOLOGY CO., LTD. (CN)

( * ) Notice: Subject to any disclaimer, the term of this patent is extended or adjusted under 35 U.S.C. 154(b) by 105 days.

(21) Appl. No.: 14/892,170

(22) PCT Filed: Apr. 27, 2015

(86) PCT No.: PCT/CN2015/077511

§ 371 (c)(1),
(2) Date: Nov. 18, 2015

(87) PCT Pub. No.: WO2016/107026

PCT Pub. Date: Jul. 7, 2016

(65) Prior Publication Data

US 2016/0351125 A1 Dec. 1, 2016

(30) Foreign Application Priority Data

Dec. 30, 2014 (CN) ..... 2014 1 0841476

(51) Int. Cl.
*G09G 5/10* (2006.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3258; G09G 3/32; G09G 3/3266; G09G 3/3291; G09G 2300/043;
(Continued)

(56) References Cited

U.S. PATENT DOCUMENTS

2014/0225878 A1* 8/2014 Shih ..... G09G 3/3258 345/205
2015/0317931 A1* 11/2015 Tseng ..... G09G 3/3233 345/78

* cited by examiner

*Primary Examiner* — Towfiq Elahi
(74) *Attorney, Agent, or Firm* — Brooks Kushman P.C.

(57) ABSTRACT

The present disclosure provides a pixel driving circuit, a pixel driving method and a display apparatus. The pixel driving circuit includes a pre-charging control unit, a storage capacitor, a driving transistor and a threshold compensation unit. The pre-charging control unit charges the storage capacitor by a supply voltage during a pre-charging period; the threshold compensation unit during the threshold compensation period, together with the driving transistor and under the control of the control signal, controls the storage capacitor to be discharged until a voltage of the second electrode of the driving transistor becomes Vdata+Vth; and during a light-emitting period, control a gate-source voltage of the driving transistor to compensate for Vth, where Vth is a threshold voltage of the driving transistor, and Vdata is a voltage of the data signal.

18 Claims, 4 Drawing Sheets

(51) Int. Cl.
*G09G 3/3266* (2016.01)
*G09G 3/3291* (2016.01)
*G09G 3/3233* (2016.01)

(52) U.S. Cl.
CPC ..... *G09G 3/3291* (2013.01); *G09G 2300/043* (2013.01); *G09G 2300/0819* (2013.01); *G09G 2300/0842* (2013.01); *G09G 2300/0861* (2013.01); *G09G 2310/0251* (2013.01); *G09G 2310/0262* (2013.01)

(58) Field of Classification Search
CPC ... G09G 2300/0819; G09G 2300/0842; G09G 2310/0251; G09G 2310/0262
See application file for complete search history.

PIXEL DRIVING CIRCUIT, PIXEL DRIVING METHOD AND DISPLAY APPARATUS

CROSS REFERENCE OF RELATED APPLICATION

The application is the U.S. national phase of PCT Application No. PCT/CN2015/077511filed on Apr. 27, 2015, which claims priority of the Chinese Patent Application No. 201410841476.8 filed Dec. 30, 2014, the disclosures of which are incorporated in their entirety by reference herein.

TECHNICAL FIELD

The present disclosure relates to a technical field of displaying, and more particularly to a pixel driving circuit, a pixel driving method and a display apparatus.

BACKGROUND

Due to a process deviation, a threshold voltage Vth of a Thin Film Transistor (TFT) on an Active Matrix/Organic Light Emitting Diode (AMOLED) may shift, leading to non-uniform currents in different pixels. A conventional pixel driving circuit with a threshold compensation function may charge a storage capacitor by a voltage Vdata of a data signal on a data line during a pre-charging period, compensate the threshold by discharging the storage capacitor during a compensating period, and activate an Organic Light Emitting Diode (OLED) to emit light during a light-emitting period. However, such arrangement causes a complicated configuration, and a high quantity of control signals, so that an interval between adjacent pixels is narrow.

SUMMARY

An object of the present disclosure is to provide a pixel driving circuit, a pixel driving method and a display apparatus for solving a problem of a narrow interval between pixels caused by a high quantity of transistors for compensating a threshold voltage of a driving transistor in the related art.

For achieving the above object, in one aspect of the present disclosure, it is provided a pixel driving circuit including: a pre-charging control unit, a storage capacitor, a driving transistor and a threshold compensation unit, wherein a gate of the driving transistor is connected to a data line by the pre-charging control unit, a first electrode of the driving transistor is connected to a light-emitting element, and a second electrode of the driving transistor is connected to a first terminal of the storage capacitor;

a first scanning signal, a second scanning signal and a supply voltage Vdd are inputted into the pre-charging control unit respectively, and the pre-charging control unit is further connected to the first terminal of the storage capacitor, the gate of the driving transistor and the data line, respectively, and connected to a second terminal of the storage capacitor by the threshold compensation unit;

a control signal is inputted into the threshold compensation unit, and the threshold compensation unit is connected to the gate of the driving transistor, the first electrode of the driving transistor, the second terminal of the storage capacitor and the ground respectively, and configured for conducting the connection between the gate of the driving transistor and the second terminal of the storage capacitor under the control of the control signal during a pre-charging period;

the pre-charging control unit is configured for, during the pre-charging period charging the storage capacitor by the supply voltage Vdd under the control of the first scanning signal and the second scanning signal so that the voltage of the first terminal of the storage capacitor becomes the supply voltage Vdd; during a threshold compensation period, controlling, under the control of the second scanning signal, the gate of the driving transistor to be inputted with a data signal outputted by the data line during the threshold compensation period; and during a light-emitting period, controlling, under the control of the first scanning signal, the second electrode of the driving transistor to be inputted with the supply voltage Vdd; and the threshold compensation unit is further configured for, during the threshold compensation period, controlling, together with the driving transistor discharges and under the control of the control signal, the storage capacitor to be discharged until a voltage of the second electrode of the driving transistor becomes Vdata+Vth; and during the light-emitting period, conducting the connection between the gate of the driving transistor and the second terminal of the storage capacitor, so as to control Vth to be compensated by a gate-source voltage of the driving transistor, wherein Vth is a threshold voltage of the driving transistor, and Vdata is a voltage of the data signal.

Optionally, the pre-charging control unit includes:

a first pre-charging transistor, wherein the first scanning signal is inputted into a gate of the first pre-charging transistor, a first electrode of the first pre-charging transistor is connected to the first terminal of the storage capacitor, and the supply voltage is inputted into a second electrode of the first pre-charging transistor; and a second pre-charging transistor, wherein the second scanning signal is inputted into a gate of the second pre-charging transistor, a first electrode of the second pre-charging transistor is connected to the data line, and a second electrode of the second pre-charging transistor is connected to the gate of the driving transistor.

Optionally, the threshold compensation unit includes:

a first compensation transistor, wherein the control signal is inputted into a gate of the first compensation transistor, a first electrode of the first compensation transistor is connected to the second terminal of the storage capacitor, and a second electrode of the first compensation transistor is connected to the gate of the driving transistor; and a second compensation transistor, wherein a gate of the second compensation transistor is connected to the control signal, a first electrode of the second compensation transistor is connected to the ground, and a second electrode of the second compensation transistor is connected to the first electrode of the driving transistor.

Optionally, all of the first pre-charging transistor, the second pre-charging transistor, the second compensation transistor and the driving transistor are NMOS transistors, and the first compensation transistor is a PMOS transistor.

Optionally, all of the first pre-charging transistor, the second pre-charging transistor, the second compensation transistor and the driving transistor are PMOS transistors, and the first compensation transistor is an NMOS transistor.

In another aspect of the present disclosure, it is provided a pixel driving method for the pixel driving circuit, and the pixel driving method includes:

during the pre-charging period, outputting, by the data line, a zero level, conducting, by the threshold compensation unit, the connection between the gate of the driving transistor and the second terminal of the storage capacitor under the control of the control signal, and charging, by the pre-charging control unit, the storage capacitor by the supply voltage Vdd under the control of the first scanning signal and the second scanning signal, so that the voltage of the first terminal of the storage capacitor is the supply voltage Vdd; and during the threshold compensation period, outputting, by the data line, the data signal, turning on the driving transistor, controlling, by, the pre-charging control unit under the control of the second scanning signal, the gate of the driving transistor to be inputted with the data signal, controlling, by the threshold compensation unit together with the driving transistor and under the control of the control signal, discharging the storage capacitor until the voltage of the second electrode of the driving transistor becomes Vdata+Vth, wherein Vth is a threshold voltage of the driving transistor, and Vdata is a voltage of the data signal; and during the light-emitting period, controlling, by the pre-charging control unit under the control of the first scanning signal, the second electrode of the driving transistor to be inputted with the supply voltage Vdd, and conducting, by the threshold compensation unit, the connection between the gate of the driving transistor and the second terminal of the storage capacitor so that the driving transistor activates the light-emitting element to emit light, and controlling the gate-source voltage of the driving transistor to compensate for Vth.

In another aspect of the present disclosure, it is provided a pixel driving method for the above pixel driving circuit, and the pixel driving method includes:

during the pre-charging period, outputting, by the data line, a zero level, turning on the first threshold compensation transistor under the control of the control signal, and turning on the first pre-charging transistor and the second pre-charging transistor under the control of the first scanning signal and the second scanning signal, so as to charge the storage capacitor by the supply voltage;

during the threshold compensation period, turning off the first pre-charging transistor under the control of the first scanning signal, maintaining the second pre-charging transistor to be turned on under the control of the second scanning signal; outputting by the data line the data signal so that the driving transistor is turned on under the control of the data signal, turning on the second compensation transistor under the control of the control transistor, and discharging the storage capacitor to the ground through the driving transistor and the second compensation transistor until the voltage of the second electrode of the driving transistor becomes Vdata+Vth; wherein Vth is a threshold voltage of the driving transistor, and Vdata is a voltage of the data signal; and during the light-emitting period, turning on the first pre-charging transistor under the control of the first scanning signal so that the supply voltage Vdd is inputted into the second electrode of the driving transistor, and turning on the first compensation transistor and turning off the second compensation transistor under the control of the control signal to conduct the connection between the gate of the driving transistor and the second terminal of the storage capacitor, so as to turn on the driving transistor thereby to activate the light-emitting element to emit light, and controlling the gate-source voltage of the driving transistor to compensate for Vth.

In another aspect of the present disclosure, it is provided a display apparatus including the above pixel driving circuit.

In contrast to the related art, in the pixel driving circuit, the pixel driving method and the display apparatus of the present disclosure, the driving transistor may be directly controlled by the data signal upon compensating for the threshold voltage of the driving transistor, so that the number of the driving transistors is reduced, and thus the space occupied by the circuit is reduced, and the intervals between pixels can be increased.

DETAILED DESCRIPTION

In the following, it is clearly and completely described the technical solutions according to the embodiments of the present disclosure. It is obvious that the described embodiments are merely some of all the embodiment of the present disclosure instead of all the embodiments. All of other embodiment that those skilled in the art may be implemented based on the embodiments in the present disclosure without creative work should also be fallen within the scope of the present disclosure.

The transistors adopted in all embodiments of the present disclosure may be thin film transistors, field effect transistors, or other similar transistors. In the embodiments of the present disclosure, two electrodes, rather than a gate electrode, of a transistor, are called a first electrode and a second electrode.

Figure 1:
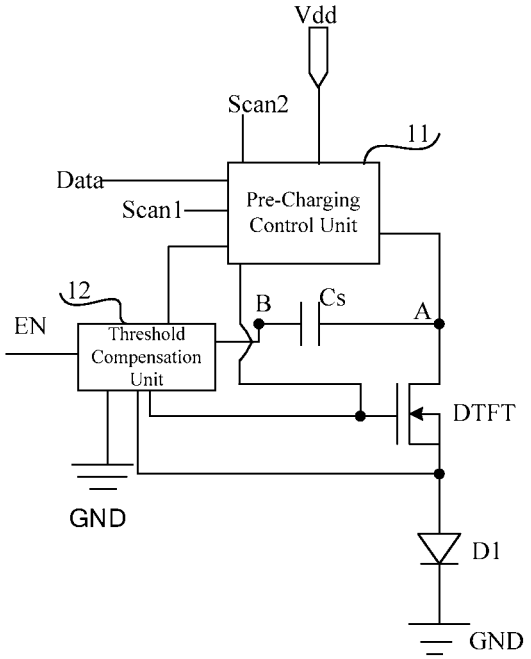
FIG. 1 illustrates a configuration of a pixel driving circuit according to an embodiment of the present disclosure.

As illustrated in FIG. 1, a pixel driving circuit according to an embodiment of the present disclosure includes: a pre-charging control unit 11, a storage capacitor Cs, a driving transistor DTFT and a threshold compensation unit 12.

A gate of the driving transistor DTFT is connected to a data line Data by the pre-charging control unit 11, a first electrode of the driving transistor DTFT is connected to an anode of a light-emitting element D1, and a second electrode of the driving transistor DTFT is connected to a first terminal A of the storage capacitor Cs; and a cathode of the light-emitting element D1 is connected to the ground GND.

A first scanning signal Scan1, a second scanning signal Scan 2 and a supply voltage Vdd are inputted into the pre-charging control unit 11 respectively, and the pre-charging control unit 11 is further connected to the first terminal A of the storage capacitor Cs, the gate of the driving transistor and the data line Data respectively, and connected to a second terminal B of the storage capacitor Cs by the threshold compensation unit.

A control signal EN is inputted into the threshold compensation unit 12, and the threshold compensation unit 12 is connected to the gate of the driving transistor DTFT, the first electrode of the driving transistor DTFT, the second terminal B of the storage capacitor Cs and the ground GND, and configured for conducting the connection between the gate of the driving transistor DTFT and the second terminal B of the storage capacitor Cs under the control of the control signal EN during a pre-charging period.

The pre-charging control unit is configured for, during the pre-charging period, charging the storage capacitor Cs by the supply voltage Vdd under the control of the first scanning signal Scan1 and the second scanning signal Scan2 so that the voltage of the first terminal of the storage capacitor becomes the supply voltage Vdd; during a threshold compensation period, controlling, under the control of the second scanning signal Scan2, the gate of the driving transistor DTFT to be inputted with a data signal outputted by the data line Data during the threshold compensation period; and during a light-emitting period, controlling, under the control of the first scanning signal Scan1, the second electrode of the driving transistor DTFT to be inputted with the supply voltage Vdd.

The threshold compensation unit 12 is further configured for, during the threshold compensation period, controlling, together with the driving transistor DTFT and under the control of the control signal EN, the storage capacitor Cs to be discharged until a voltage of the second electrode of the driving transistor DTFT becomes Vdata+Vth; and during the light-emitting period, conducting the connection between the gate of the driving transistor DTFT and the second terminal B of the storage capacitor Cs, so as to control Vth to be compensated by a gate-source voltage of the driving transistor DTFT, wherein Vth is a threshold voltage of the driving transistor DTFT, and Vdata is a voltage of the data signal.

In the pixel driving circuit of embodiments of the present disclosure, the driving transistor DTFT may be directly controlled by the data signal on the data line Data, so that the number of the driving transistors is reduced while the threshold voltage of the driving transistor is compensated, and thus the space occupied by the circuit is reduced, and the intervals between pixels is increased.

In the implementation, the pre-charging control unit may includes:

a first pre-charging transistor, wherein the first scanning signal is inputted into a gate of the first pre-charging transistor, a first electrode of the first pre-charging transistor is connected to the first terminal of the storage capacitor, and the supply voltage is inputted into a second electrode of the first pre-charging transistor; and a second pre-charging transistor, wherein the second scanning signal is inputted into a gate of the second pre-charging transistor, a first electrode of the second pre-charging transistor is connected to the data line, and a second electrode of the second pre-charging transistor is connected to the gate of the driving transistor.

In the implementation, the threshold compensation unit may includes:

a first compensation transistor, wherein a gate of the first compensation transistor is connected to the control signal, a first electrode of the first compensation transistor is connected to the second terminal of the storage capacitor, and a second electrode of the first compensation transistor is connected to the gate of the driving transistor; and a second compensation transistor, wherein a gate of the second compensation transistor is connected to the control signal, a first electrode of the second compensation transistor is connected to the ground, and a second electrode of the second compensation transistor is connected to the first electrode of the driving transistor.

In the following, the pixel driving circuit of the present disclosure is further explained in accordance with the specific embodiments.

Figure 2:
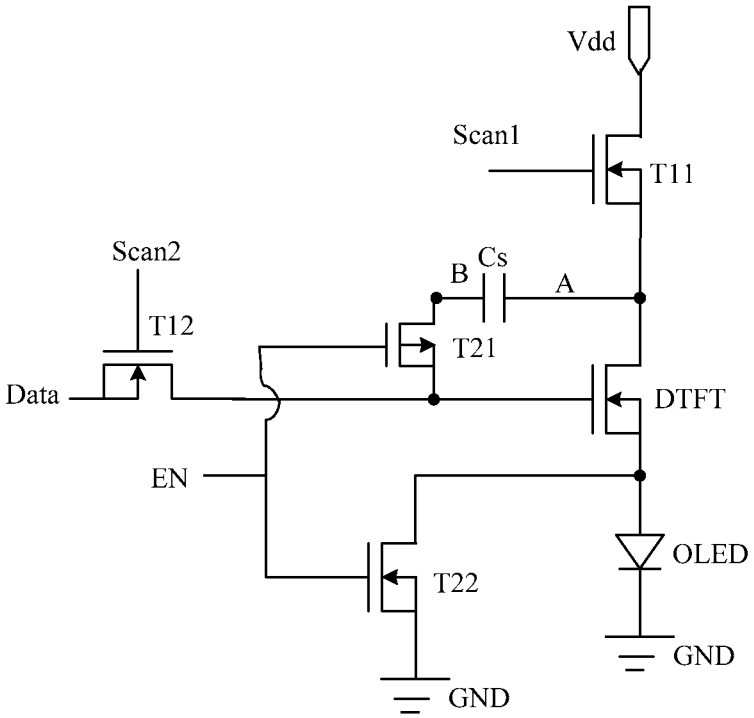
FIG. 2 illustrates another configuration of a pixel driving circuit according to an embodiment of the present disclosure.

As illustrated in FIG. 2, in a pixel driving circuit of an embodiment of the present disclosure, the light-emitting element is an Organic Light-Emitting Diode (OLED).

The pre-charging control unit includes:

a first pre-charging transistor T1, wherein the first scanning signal Scan1 is inputted into a gate of the first pre-charging transistor T1, a first electrode of the first pre-charging transistor T1 is connected to a first terminal A of the storage capacitor Cs, and the supply voltage Vdd is inputted into a second electrode of the first pre-charging transistor T1; and a second pre-charging transistor T12, wherein the second scanning signal Scan2 is inputted into a gate of the second pre-charging transistor T12, a first electrode of the second pre-charging transistor T12 is connected to the data line Data, and a second electrode of the second pre-charging transistor T12 is connected to the gate of the driving transistor DTFT.

The threshold compensation unit includes:

a first compensation transistor T21, wherein the control signal EN is inputted into a gate of the first compensation transistor T21, a first electrode of the first compensation transistor T21 is connected to a second terminal B of the storage capacitor Cs, and a second electrode of the first compensation transistor T21 is connected to the gate of the driving transistor DTFT; and a second compensation transistor T22, wherein a gate of the second compensation transistor T22 is connected to the control signal EN, a first electrode of the second compensation transistor T22 is connected to the ground GND, and a second electrode of the second compensation transistor T22 is connected to the first electrode of the driving transistor DTFT.

The gate of the driving transistor DTFT is connected to the data line Data through the second pre-charging transistor T12, the first electrode of the driving transistor DTFT is connected to the anode of the OLED, and the second electrode of the driving transistor DTFT is connected to the first electrode of the first pre-charging transistor T11.

The cathode of the OLED is connected to the ground GND.

In the embodiment of the pixel driving circuit as illustrated in FIG. 2, all of the first pre-charging transistor, the second pre-charging transistor, the second compensation transistor and the driving transistor are N-Metal-Oxide-Semiconductor (NMOS) transistors, and the first compensation transistor is a P-Metal-Oxide-Semiconductor (PMOS) transistor. The types of the first compensation transistor and the second compensation transistor are arranged to be different, so as to reduce the number of the control signals and facilitate the circuit design.

In the embodiment of the pixel driving circuit as illustrated in FIG. 2, a 5T1C (five Transistors and one Capacitors) configuration is adopted to compensate for the threshold voltage of the driving transistor and the driving transistor is controlled by the data signal, which reduces the number of transistors and saves a transistor comparing to a 6T1C configuration. Furthermore, in this embodiment of the present disclosure, one control signal is adopted to control two compensation transistors of different types, so that the number of the control signals is reduced, and thus the space occupied by the circuit is reduced, and the intervals between pixels is increased.

Figure 3:
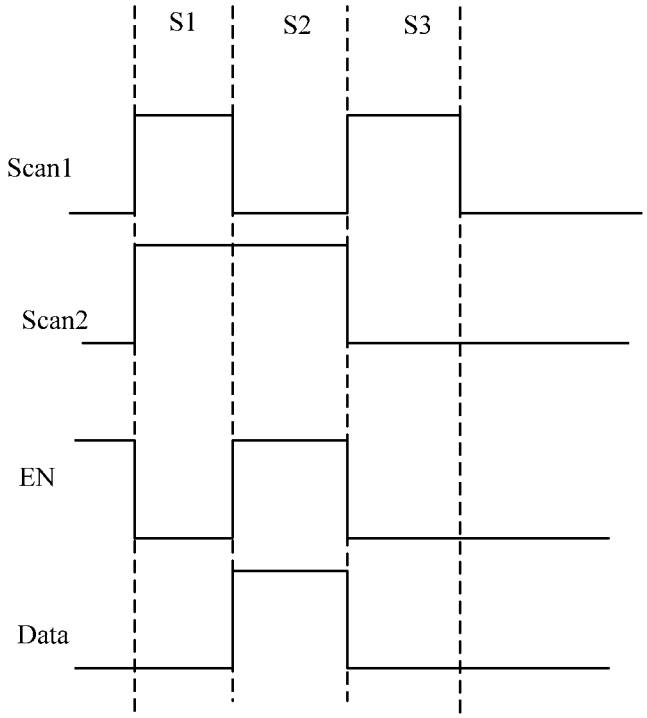
FIG. 3 is a timing diagram of signals for a pixel driving circuit according to an embodiment of the present disclosure.

FIG. 3 is a timing diagram of the first scanning signal Scan1, the second scanning signal Scan2, the control signal EN and the Vdata during the pre-charging period S1, the threshold compensation period S2 and the light emitting period S3. Accordingly, the operation of the pixel driving circuit as illustrated in FIG. 2 is as follows.

Figure 4A:
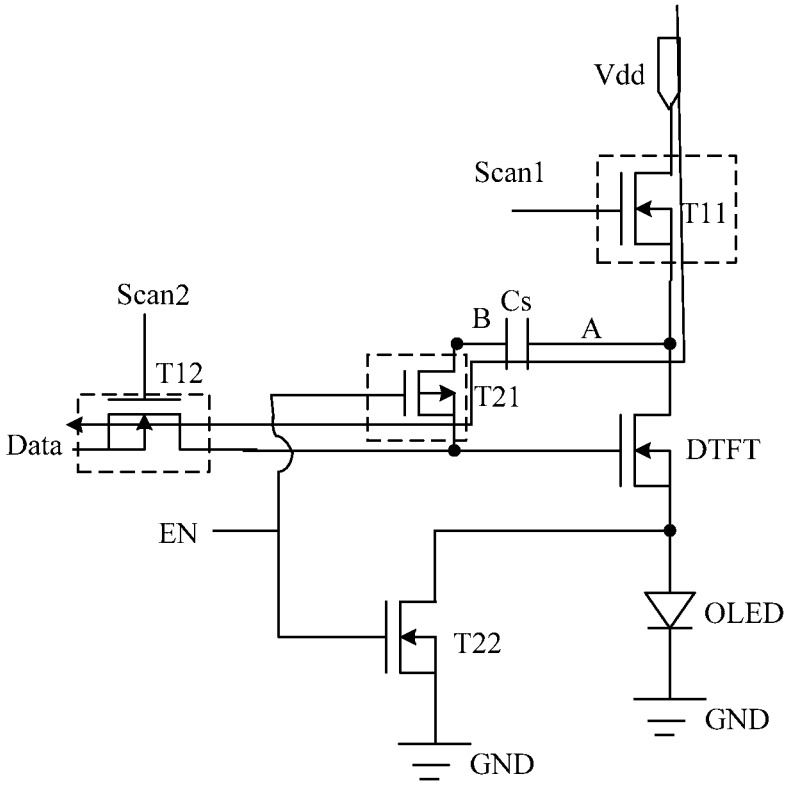
FIG. 4A illustrates an operation of a pixel driving circuit during a pre-charging period S1 according to an embodiment of the present disclosure.

As illustrated in FIG. 4A, during the pre-charging period D1, both the first scanning signal Scan1 and the second scanning signal Scan2 are of a high level, the data line Data outputs a zero level, and the control signal EN is of a low level, both the first pre-charging transistor T11 and the second pre-charging transistor T12 are turned on, and the first compensation transistor T21 is turned on, then the storage capacitor Cs is charged by the supply voltage Vdd.

Figure 4B:
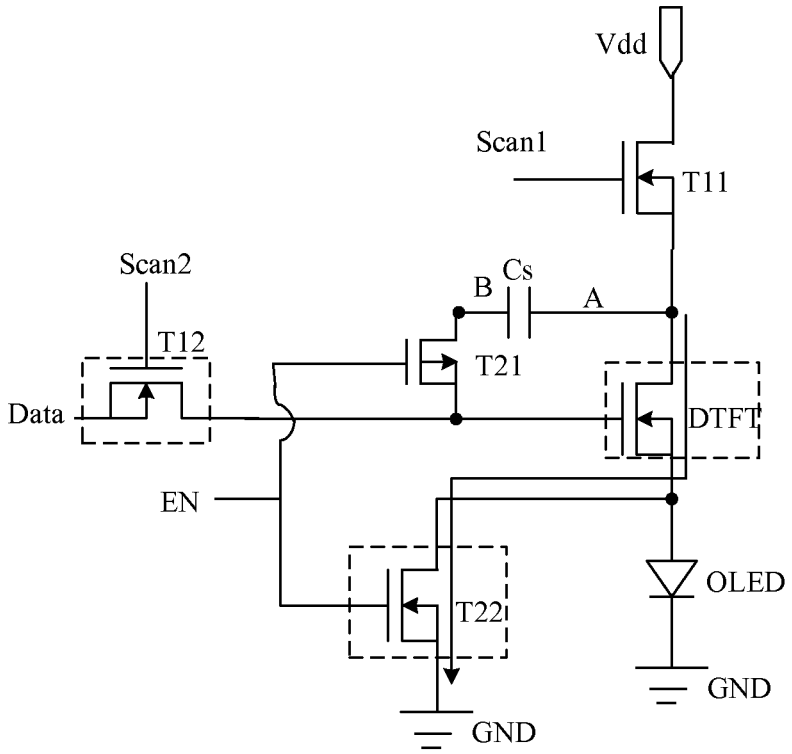
FIG. 4B illustrates an operation of a pixel driving circuit during a threshold compensation period S2 according to an embodiment of the present disclosure.

As illustrated in FIG. 4B, during the threshold compensation period S2, the first scanning signal Scan 1 jumps to be of a low level, the second scanning signal Scan 2 is maintained to be of a high level, the control signal EN jumps to be of a high level, the first pre-charging transistor T11 is turned off, and the second pre-charging transistor T12 is maintained to be turned on; and at this time, the data line Data outputs the data signal so that the driving transistor DTFT is turned on; the second compensation transistor T22 is turned on, and the storage capacitor Cs is discharged to the ground GND through the driving transistor DTFT and the second compensation transistor T22 until the voltage of the second electrode of the driving transistor DTFT, i.e. the voltage at the point A is Vdata+Vth; wherein Vth is a threshold voltage of the driving transistor DTFT, and Vdata is a voltage of the data signal on the data line Data.

Figure 4C:
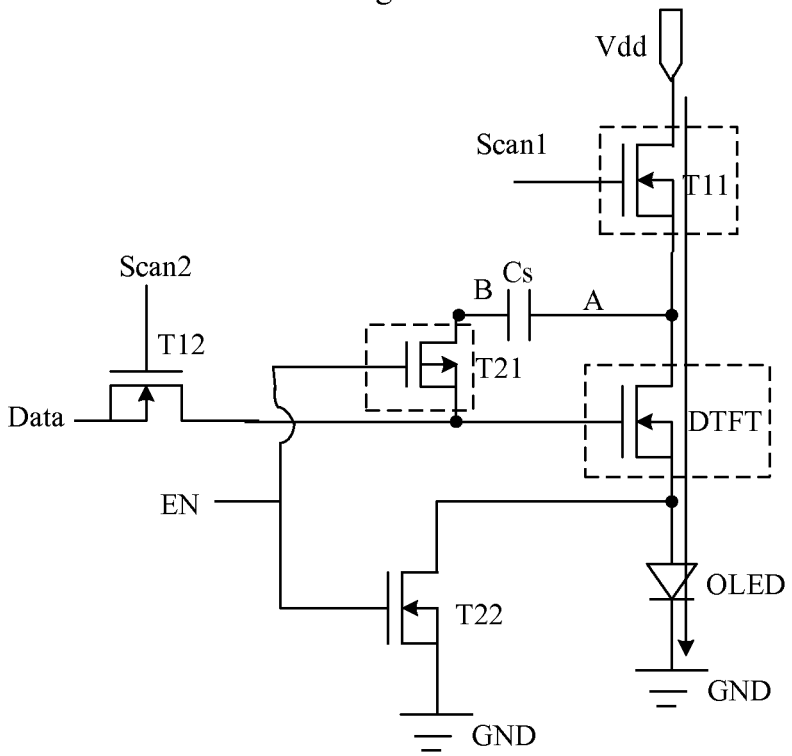
FIG. 4C illustrates an operation of a pixel driving circuit during a light-emitting period S3 according to an embodiment of the present disclosure.

As illustrated in FIG. 4C, during this light-emitting period S3, the first scanning signal Scan1 jumps to be of a high level, the second scanning signal Scan2 jumps to be of a low level, the first pre-charging transistor T11 is turned on, and the second pre-charging transistor T12 is turned off, so that the supply voltage Vdd is inputted into the second electrode of the driving transistor DTFT; the control signal EN jumps to be of a low level, and the first compensation transistor is turned on and the second compensation transistor T22 is turned off under the control of the control signal EN, so as to conduct the connection between the gate of the driving transistor DTFT and the second terminal B of the storage capacitor; a voltage of the gate of the driving transistor DTFT is bootstrapped by the storage capacitor to be Vdd−(Vdata+Vth), the driving transistor is turned on to activate the light-emitting element to emit light; at this time, the current passing through the OLED is $I=K\times(Vdd-(Vdd-Vdata-Vth)-Vth)^2=K\times Vdata^2$, wherein K is a constant; thus, Vth is compensated by a gate-source voltage of the driving transistor DTFT.

In FIGS. 4A, 4B and 4C, the transistors in the block with dot lines are in a state of being turned on.

Figure 5:
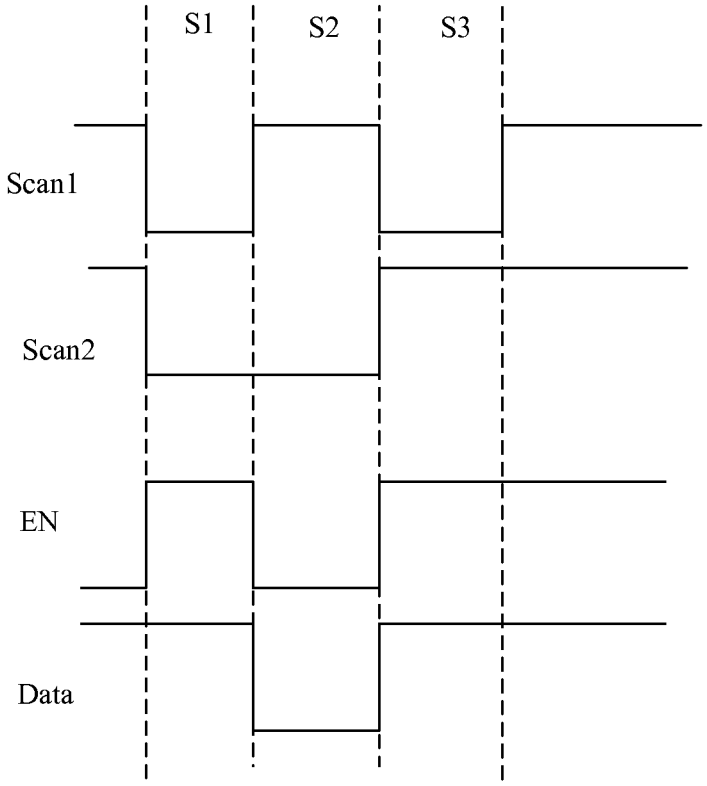
FIG. 5 is another timing diagram of signals for a pixel driving circuit according to an embodiment of the present disclosure.

In the embodiment of the pixel driving circuit as illustrated in FIG. 2, all of the first pre-charging transistor T11, the second pre-charging transistor T12, the second compensation transistor T22 and the driving transistor DTFT may be PMOS transistors, and then the first compensation transistor T21 may be an NMOS transistor. As illustrated in FIG. 5, in the implementation, it only needs to arrange the first scanning signal Scan1, the second scanning signal Scan2, the data signal on the data line Data and the control signal EN to be of an opposite phase. The changes of the types of the transistors and the timing of the signals as mentioned above are known for those skilled in the art, and thus the explanations thereof are omitted.

According to another embodiment of the present disclosure, it is provided a pixel driving method for the above pixel driving circuit, including:

during the pre-charging period, outputting by the data line a zero level, conducting by the threshold compensation unit, the connection between the gate of the driving transistor and the second terminal of the storage capacitor under the control of the control signal, and charging, by the pre-charging control unit, the storage capacitor by the supply voltage Vdd under the control of the first scanning signal and the second scanning signal, so that the voltage of the first terminal of the storage capacitor is the supply voltage Vdd; and during the threshold compensation period, outputting, by the data line, the data signal, turning on the driving transistor, controlling, by the pre-charging control unit under the control of the second scanning signal, the gate of the driving transistor to be inputted with the data signal, controlling, by the threshold compensation unit together with the driving transistor and under the control of the control signal, the storage capacitor to be discharged until the voltage of the second electrode of the driving transistor becomes Vdata+Vth, wherein Vth is a threshold voltage of the driving transistor, and Vdata is a voltage of the data signal; and during the light-emitting period, controlling, by the pre-charging control unit, under the control of the first scanning signal, the second electrode of the driving transistor to be inputted with the supply voltage Vdd, and conducting, by the threshold compensation unit, the connection between the gate of the driving transistor and the second terminal of the storage capacitor so that the driving transistor activates the light-emitting element to emit light, and controlling the gate-source voltage of the driving transistor to compensate for Vth.

According to an embodiment of the present disclosure, it is provided another pixel driving method for the above pixel driving circuit, including:

during the pre-charging period, outputting, by the data line, a zero level, turning on the first threshold compensation transistor under the control of the control signal, and turning on the first pre-charging transistor and the second pre-charging transistor under the control of the first scanning signal and the second scanning signal, so as to charge the storage capacitor by the supply voltage;

during the threshold compensation period, turning off the first pre-charging transistor under the control of the first scanning signal, maintaining the second pre-charging transistor to be turned on under the control of the second scanning signal; outputting, by the data line, the data signal so that the driving transistor is turned on under the control of the data signal; turning on the second compensation transistor under the control of the control transistor, and discharging the storage capacitor to the ground through the driving transistor and the second compensation transistor until the voltage of the second electrode of the driving transistor becomes Vdata+Vth; wherein Vth is a threshold voltage of the driving transistor, and Vdata is a voltage of the data signal; and during the light-emitting period, turning on the first pre-charging transistor under the control of the first scanning signal so that the supply voltage Vdd is inputted into the second electrode of the driving transistor, and turning on the first compensation transistor and turning off the second compensation transistor under the control of the control signal to conduct the connection between the gate of the driving transistor and the second terminal of the storage capacitor, so as to turn on the driving transistor thereby to activate the light-emitting element to emit light, and controlling the gate-source voltage of the driving transistor to compensate for Vth.

According to another embodiment of the present disclosure, it is provided a display apparatus including the above pixel driving circuit.

The display apparatus may be a Liquid Crystal Display (LCD) monitor, a LCD TV, an OLED display panel, an OLED monitor, an OLED TV, an electronic paper, or etc.

The above are merely the preferred embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure.

What is claimed is:

1. A pixel driving circuit, comprising: a pre-charging control unit, a storage capacitor, a driving transistor and a threshold compensation unit, wherein a gate of the driving transistor is directly connected to a data line by the pre-charging control unit, a first electrode of the driving transistor is directly connected to a light-emitting element, and a second electrode of the driving transistor is directly connected to a first terminal of the storage capacitor;

a first scanning signal, a second scanning signal and a supply voltage Vdd are inputted into the pre-charging control unit respectively, and the pre-charging control unit is further directly connected to the first terminal of the storage capacitor, the gate of the driving transistor and the data line, respectively, and directly connected to a second terminal of the storage capacitor by the threshold compensation unit;

a control signal is inputted into the threshold compensation unit, and the threshold compensation unit is directly connected to the gate of the driving transistor, the first electrode of the driving transistor, the second terminal of the storage capacitor and the ground respectively, and configured for conducting the connection between the gate of the driving transistor and the second terminal of the storage capacitor under the control of the control signal during a pre-charging period;

the pre-charging control unit is configured for, during the pre-charging period, charging the storage capacitor by the supply voltage Vdd under the control of the first scanning signal and the second scanning signal so that the voltage of the first terminal of the storage capacitor becomes the supply voltage Vdd; during a threshold compensation period, controlling, under the control of the second scanning signal, the gate of the driving transistor to be inputted with a data signal outputted by the data line during the threshold compensation period; and during a light-emitting period, controlling, under the control of the first scanning signal, the second electrode of the driving transistor to be inputted with the supply voltage Vdd; and the threshold compensation unit is further configured for, during the threshold compensation period, controlling, together with the driving transistor and under the control of the control signal, the storage capacitor to be discharged until a voltage of the second electrode of the driving transistor becomes Vdata+Vth; and during the light-emitting period, conducting the connection between the gate of the driving transistor and the second terminal of the storage capacitor, so as to control Vth to be compensated by a gate-source voltage of the driving transistor, wherein Vth is a threshold voltage of the driving transistor, and Vdata is a voltage of the data signal.

2. The pixel driving circuit according to claim 1, wherein the pre-charging control unit comprises:

a first pre-charging transistor, wherein the first scanning signal is inputted into a gate of the first pre-charging transistor, a first electrode of the first pre-charging transistor is connected to the first terminal of the storage capacitor, and the supply voltage is inputted into a second electrode of the first pre-charging transistor; and a second pre-charging transistor, wherein the second scanning signal is inputted into a gate of the second pre-charging transistor, a first electrode of the second pre-charging transistor is connected to the data line, and a second electrode of the second pre-charging transistor is connected to the gate of the driving transistor.

3. The pixel driving circuit according to claim 2, wherein the threshold compensation unit comprises:

a first compensation transistor, wherein the control signal is inputted into a gate of the first compensation transistor, a first electrode of the first compensation transistor is connected to the second terminal of the storage capacitor, and a second electrode of the first compensation transistor is connected to the gate of the driving transistor; and a second compensation transistor, wherein a gate of the second compensation transistor is connected to the control signal, a first electrode of the second compensation transistor is connected to the ground, and a second electrode of the second compensation transistor is connected to the first electrode of the driving transistor.

4. The pixel driving circuit according to claim 3, wherein all of the first pre-charging transistor, the second pre-charging transistor, the second compensation transistor and the driving transistor are N-Metal-Oxide-Semiconductor (NMOS) transistors, and the first compensation transistor is a P-Metal-Oxide-Semiconductor (PMOS) transistor.

5. The pixel driving circuit according to claim 3, wherein all of the first pre-charging transistor, the second pre-charging transistor, the second compensation transistor and the driving transistor are PMOS transistors, and the first compensation transistor is an NMOS transistor.

6. A pixel driving method for the pixel driving circuit according to claim 1, comprising:

during the pre-charging period, outputting, by the data line, a zero level, conducting, by the threshold compensation unit, the connection between the gate of the driving transistor and the second terminal of the storage capacitor under the control of the control signal, and charging, by the pre-charging control unit, the storage capacitor by the supply voltage Vdd under the control of the first scanning signal and the second scanning signal, so that the voltage of the first terminal of the storage capacitor is the supply voltage Vdd; and during the threshold compensation period, outputting, by the data line, the data signal, turning on the driving transistor, controlling, by the pre-charging control unit under the control of the second scanning signal, the gate of the driving transistor to be inputted with the data signal, controlling, by the threshold compensation unit together with the driving transistor and under the control of the control signal, the storage capacitor to be discharged until the voltage of the second electrode of the driving transistor becomes Vdata+Vth, wherein Vth is a threshold voltage of the driving transistor, and Vdata is a voltage of the data signal; and during the light-emitting period, controlling, by the pre-charging control unit under the control of the first scanning signal, the second electrode of the driving transistor to be inputted with the supply voltage Vdd, and conducting, by the threshold compensation unit, the connection between the gate of the driving transistor and the second terminal of the storage capacitor so that the driving transistor activates the light- emitting element to emit light, and controlling the gate-source voltage of the driving transistor to compensate for Vth.

7. A pixel driving method for the pixel driving circuit according to claim 3, comprising:

during the pre-charging period, outputting, by the data line, a zero level, turning on the first threshold compensation transistor under the control of the control signal, and turning on the first pre-charging transistor and the second pre-charging transistor under the control of the first scanning signal and the second scanning signal, so as to charge the storage capacitor by the supply voltage;

during the threshold compensation period, turning off the first pre-charging transistor under the control of the first scanning signal, maintaining the second pre-charging transistor to be turned on under the control of the second scanning signal; outputting, by the data line, the data signal so that the driving transistor is turned on under the control of the data signal, turning on the second compensation transistor under the control of the control signal, and discharging the storage capacitor to the ground through the driving transistor and the second compensation transistor until the voltage of the second electrode of the driving transistor becomes Vdata+Vth; wherein Vth is a threshold voltage of the driving transistor, and Vdata is a voltage of the data signal; and during the light-emitting period, turning on the first pre-charging transistor under the control of the first scanning signal so that the supply voltage Vdd is inputted into the second electrode of the driving transistor, turning on the first compensation transistor and turning off the second compensation transistor under the control of the control signal to conduct the connection between the gate of the driving transistor and the second terminal of the storage capacitor so as to turn on the driving transistor thereby to activate the light-emitting element to emit light, and controlling the gate-source voltage of the driving transistor to compensate for Vth.

8. A display apparatus comprising the pixel driving circuit according to claim 1.

9. The method according to claim 6, wherein the pre-charging control unit comprises:

a first pre-charging transistor, wherein the first scanning signal is inputted into a gate of the first pre-charging transistor, a first electrode of the first pre-charging transistor is connected to the first terminal of the storage capacitor, and the supply voltage is inputted into a second electrode of the first pre-charging transistor; and a second pre-charging transistor, wherein the second scanning signal is inputted into a gate of the second pre-charging transistor, a first electrode of the second pre-charging transistor is connected to the data line, and a second electrode of the second pre-charging transistor is connected to the gate of the driving transistor.

10. The method according to claim 9, wherein the threshold compensation unit comprises:

a first compensation transistor, wherein the control signal is inputted into a gate of the first compensation transistor, a first electrode of the first compensation transistor is connected to the second terminal of the storage capacitor, and a second electrode of the first compensation transistor is connected to the gate of the driving transistor; and a second compensation transistor, wherein a gate of the second compensation transistor is connected to the control signal, a first electrode of the second compensation transistor is connected to the ground, and a second electrode of the second compensation transistor is connected to the first electrode of the driving transistor.

11. The method according to claim 10, wherein all of the first pre-charging transistor, the second pre-charging transistor, the second compensation transistor and the driving transistor are N-Metal-Oxide-Semiconductor (NMOS) transistors, and the first compensation transistor is a P-Metal-Oxide-Semiconductor (PMOS) transistor.

12. The method according to claim 10, wherein all of the first pre-charging transistor, the second pre-charging transistor, the second compensation transistor and the driving transistor are PMOS transistors, and the first compensation transistor is an NMOS transistor.

13. The method according to claim 7, wherein all of the first pre-charging transistor, the second pre-charging transistor, the second compensation transistor and the driving transistor are N-Metal-Oxide-Semiconductor (NMOS) transistors, and the first compensation transistor is a P-Metal-Oxide-Semiconductor (PMOS) transistor.

14. The method according to claim 7, wherein all of the first pre-charging transistor, the second pre-charging transistor, the second compensation transistor and the driving transistor are PMOS transistors, and the first compensation transistor is an NMOS transistor.

15. The display apparatus according to claim 8, wherein the pre-charging control unit comprises:

a first pre-charging transistor, wherein the first scanning signal is inputted into a gate of the first pre-charging transistor, a first electrode of the first pre-charging transistor is connected to the first terminal of the storage capacitor, and the supply voltage is inputted into a second electrode of the first pre-charging transistor; and a second pre-charging transistor, wherein the second scanning signal is inputted into a gate of the second pre-charging transistor, a first electrode of the second pre-charging transistor is connected to the data line, and a second electrode of the second pre-charging transistor is connected to the gate of the driving transistor.

16. The display apparatus according to claim 15, wherein the threshold compensation unit comprises:

a first compensation transistor, wherein the control signal is inputted into a gate of the first compensation transistor, a first electrode of the first compensation transistor is connected to the second terminal of the storage capacitor, and a second electrode of the first compensation transistor is connected to the gate of the driving transistor; and a second compensation transistor, wherein a gate of the second compensation transistor is connected to the control signal, a first electrode of the second compensation transistor is connected to the ground, and a second electrode of the second compensation transistor is connected to the first electrode of the driving transistor.

17. The display apparatus according to claim 16, wherein all of the first pre-charging transistor, the second pre-charging transistor, the second compensation transistor and the driving transistor are N-Metal-Oxide-Semiconductor (NMOS) transistors, and the first compensation transistor is a P-Metal-Oxide-Semiconductor (PMOS) transistor.

18. The display apparatus according to claim 16, wherein all of the first pre-charging transistor, the second pre-charging transistor, the second compensation transistor and the driving transistor are PMOS transistors, and the first compensation transistor is an NMOS transistor.

* * * * *